US008151607B2

(12) United States Patent
Bearzot

(10) Patent No.: US 8,151,607 B2
(45) Date of Patent: Apr. 10, 2012

(54) METHOD AND APPARATUS FOR QUARANTINING PALLETISED GOODS AND PREVENTING PALLET MOVEMENT

(75) Inventor: George Bearzot, Sydney (AU)

(73) Assignee: Lion Nathan Australia Pty Ltd., Sydney (AU)

( * ) Notice: Subject to any disclaimer, the term of this patent is extended or adjusted under 35 U.S.C. 154(b) by 651 days.

(21) Appl. No.: 11/920,329

(22) PCT Filed: May 12, 2006

(86) PCT No.: PCT/AU2006/000633
§ 371 (c)(1),
(2), (4) Date: Dec. 1, 2008

(87) PCT Pub. No.: WO2006/119581
PCT Pub. Date: Nov. 16, 2006

(65) Prior Publication Data

US 2009/0193857 A1 Aug. 6, 2009

(30) Foreign Application Priority Data

May 12, 2005 (AU) ..... 2005902415

(51) Int. Cl.
*E05B 69/00* (2006.01)
*E05B 73/00* (2006.01)

(52) U.S. Cl. ..... 70/58; 70/14; 70/57; 70/158; 70/163

(58) Field of Classification Search ..... 70/14, 57, 70/58, 416, 455, 158, 163, 166, 167, 168, 70/169
See application file for complete search history.

(56) References Cited

U.S. PATENT DOCUMENTS

| | | | | |
|---|---|---|---|---|
| 4,655,057 | A * | 4/1987 | Derman | 70/14 |
| 4,768,906 | A | 9/1988 | Gerhard | |
| 4,959,979 | A * | 10/1990 | Filipow et al. | 70/58 |
| 4,977,762 | A * | 12/1990 | Dennis | 70/14 |
| 5,124,871 | A * | 6/1992 | Smith | 360/137 |
| 5,367,423 | A * | 11/1994 | Phillips | 360/137 |
| 5,626,252 | A * | 5/1997 | Trotman | 220/789 |
| 6,192,807 | B1 * | 2/2001 | Mason | 108/51.11 |
| 6,408,768 | B1 * | 6/2002 | Giampavolo et al. | 108/27 |

FOREIGN PATENT DOCUMENTS

SU 1532441 12/1989

* cited by examiner

*Primary Examiner* — Suzanne Barrett
*Assistant Examiner* — David E. Sosnowski
(74) *Attorney, Agent, or Firm* — Foley & Lardner LLP

(57) ABSTRACT

A pallet arrestor and method for preventing the movement of a pallet, having one or more pallet tunnels for receiving the tines of a forklift is disclosed. The pallet arrestor includes a molded plastic plug which has a first portion which is configured to slot into a pallet tunnel and a front portion whose height prevents its entry into the tunnel. The pallet arrestor prevents ingress of a forklift tine into that pallet tunnel, and hence inhibits movement of the pallet, without having to move the pallet to a caged area, or the like. The plug may include a rotatable latch which in one (retracted) position allows the pallet arrestor to be inserted and removed from the pallet tunnel and which in a second (locked) position prevents or inhibits the removal of the pallet arrestor from the pallet tunnel.

10 Claims, 1 Drawing Sheet

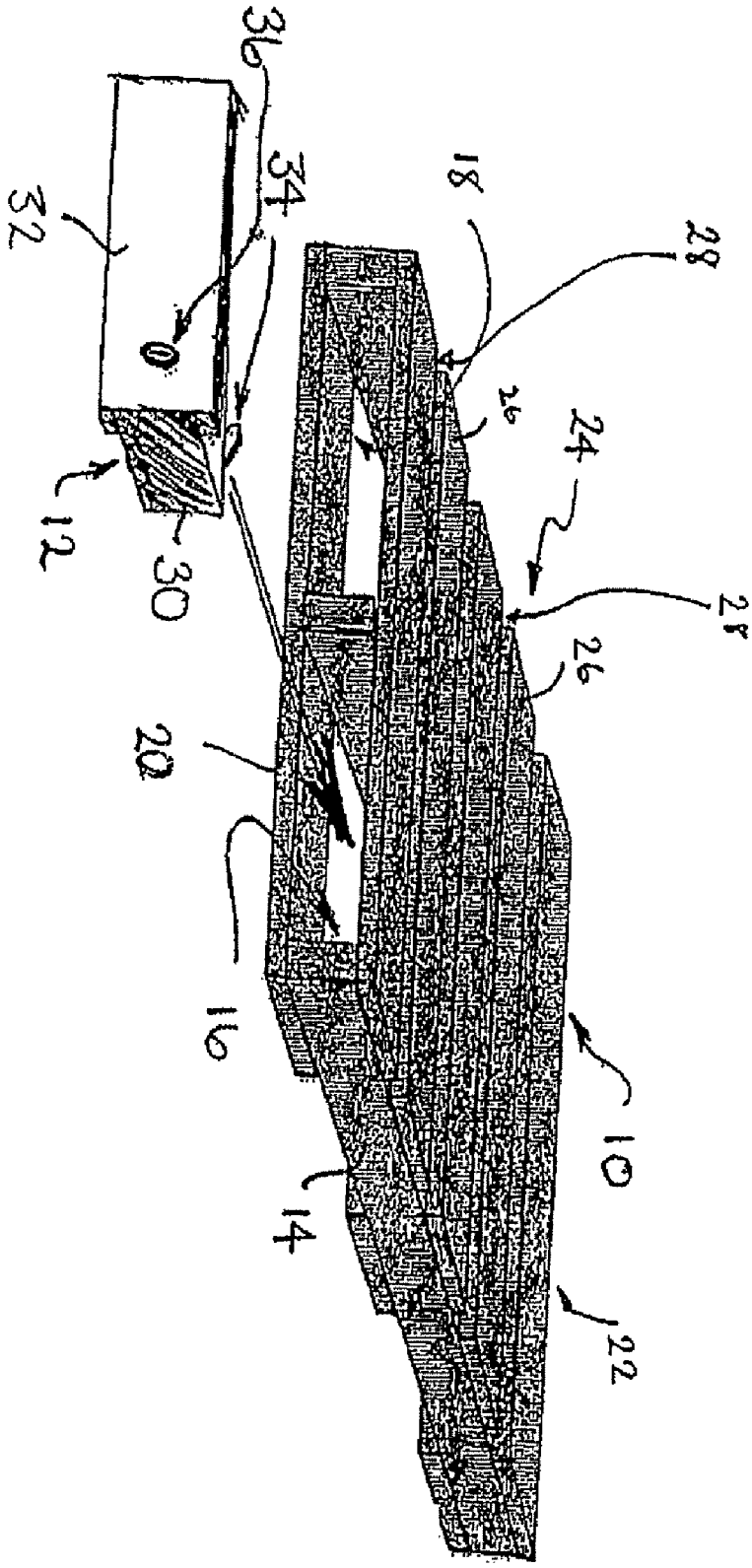
10
12
14
16
18
20
22
24
26
28
30
32
34
36

METHOD AND APPARATUS FOR QUARANTINING PALLETISED GOODS AND PREVENTING PALLET MOVEMENT

CROSS-REFERENCE TO RELATED APPLICATIONS

The present application claims priority from Australian Provisional Patent Application No 2005902415 filed on 12 May 2005, the content of which is incorporated herein by reference.

FIELD OF THE INVENTION

This invention relates to a method and apparatus for quarantining palletised goods and preventing the movement of pallets.

BACKGROUND OF THE INVENTION

In the field of logistics, packaged products are most commonly carried and transported on pallets. It is sometimes necessary to prevent the movement of one or more pallets of product from a warehouse, or to ensure that those pallets are retained in the warehouse for a predetermined period of time before proceeding down the distribution chain to a wholesaler, retailer or the like. Currently, this is often achieved by transporting the pallets of product to a secure caged and/or locked area. However, for some heavier bulkier products, this is impractical. For example, in the case of beer, it is often a requirement that after bottling, the beer be allowed to rest for a predetermined period of time before being despatched to retailers or wholesalers. Because of the volumes of beer involved, it is simply impractical to hold the pallets in a secure area.

Other situations where quarantining pallets is desirable occur where product is manufactured and packaged for a particular promotion where it may be desirable to clear a warehouse of non promotional stock before any of the promotional material is despatched. Other situations where quarantining pallets is desirable, include when palletised product is held for being out of quality specification and unable to be released for sale.

The present invention is concerned with an improved method and apparatus for arresting the movement of pallets and which is particularly suited to use in situations where a large number of pallets have to be quarantined and where moving the pallets to a caged area is impractical, or too time-consuming, or too expensive.

Any discussion of documents, acts, materials, devices, articles or the like which has been included in the present specification is solely for the purpose of providing a context for the present invention. It is not to be taken as an admission that any or all of these matters form part of the prior art base or were common general knowledge in the field relevant to the present invention as it existed before the priority date of each claim of this application.

SUMMARY OF THE INVENTION

In a first broad aspect, the present invention provides a device, or pallet arrestor, for preventing the movement of a pallet defining one or more pallet tunnels for receiving the tines of a forklift, the device comprising: a plug which is shaped and configured to locate in one of the tunnels of the pallet to prevent ingress of a forklift tine into that tunnel.

Thus the present invention provides a device that prevents a fork lift truck tine from entering and lifting a pallet and hence prevents or inhibits movement of the same without having to move the pallet to a secure caged area.

The plug is typically made from a moulded plastics material, although other suitable materials could be used, and includes a first portion which is configured to slot into a pallet tunnel and a second or front portion whose height prevents its entry into the tunnel.

Preferably the plug will include a rotatable latch which in one (retracted) position allows the pallet arrestor to be inserted and removed from the pallet tunnel and which in a second (locked) position prevents or inhibits the removal of the pallet arrestor from the pallet tunnel. However, the plug may also be configured without a rotatable latch and rely solely on friction to keep it located within the pallet tunnel.

Typically, the latch is rotatably mounted on the distal end of the pallet arrestor and in the locked position is disposed between two of the planks forming the upper surface of the pallet. For security reasons, operation of the latch may be via a key operated lock, typically located on the front of the pallet arrestor.

In one embodiment, one or more handles may be provided on the front of the pallet arrestor for ease of removal of the same.

The pallet arrestor may be provided in various bright colours so that it can be more easily seen by forklift operators.

The front of the pallet arrestor may be embossed with information such as the permitted release date of the pallet.

In a related aspect the present invention provides a method of quarantining pallets using a pallet arresting device embodying the first aspect of the present invention and/or preferred aspects thereof.

Where a number of pallets are stacked together blocking the movement of one or more of those pallets may prevent a forklift from moving any of them.

In a yet further aspect the present invention provides a method of quarantining pallets, said pallets defining one or more pallet tunnels for receiving the tines of a forklift, the method comprising: inserting a plug which is shaped and/or configurable, in use, to locate in one of the tunnels of the pallet; and securing the plug in the pallet tunnel to prevent ingress of a forklift tine into that tunnel.

BRIEF DESCRIPTION OF THE DRAWING

A specific embodiment of the present invention will now be described by way of example only and with reference to the accompanying drawing, FIG. 1, which shows an isometric view of a pallet and pallet arrestor.

DETAILED DESCRIPTION OF A PREFERRED EMBODIMENT

Referring to the drawing, FIG. 1 shows a pallet 10 and a pallet arrestor 12 embodying the present invention. The pallet 10 shown is a two-way pallet having solid sides 14 and defining two parallel pallet entry tunnels 16, 18 which extend from the front 20 of the pallet to the rear 22 of the pallet. The top surface 24 of the pallet, is comprised by a plurality of spaced planks 26 defining gaps 28 therebetween.

The pallet arrestor 12 is in the form of a moulded plastic plug having a first portion 30 which is rectangular in section and which is sized and configured to have a height and width such that it is a relatively snug fit within the pallet tunnel and an enlarged front end portion 32 of a greater height, which is too high to enter the pallet tunnel. The pallet arrestor 12 may be hollow or solid.

A lever, or latch, 34 is rotatably mounted on the rear or distal face of the pallet arrestor 12 which enters the pallet tunnel, in use. The latch may be rotated between a locked position where it projects up above the first portion of the pallet arrestor 12, as shown in FIG. 1, and an unlocked position (not shown) where it does not project above the first portion 30. Rotation of the latch is via a mechanism (not shown) operated by a key which locates in a lock 36 defined in the front end of the pallet arrestor.

In use, the latch 34 is rotated so that it is retracted below the top of the first portion 14 of the pallet arrestor to allow the pallet arrestor 12 to be slid into one of the pallet tunnels 16 of the pallet. Once located in the pallet tunnel, the key is inserted in the lock 36 and turned to raise the latch 34 to the locked position where it projects between two adjacent planks 26 of the pallet, thus preventing removal of the pallet arrestor 12 from the pallet tunnel.

It will be appreciated that by blocking access to one of the pallet tunnels to the tine of a forklift, movement of that pallet by a forklift is prevented or inhibited. In certain circumstances where forklifts are able to access both the front and rear of a pallet or where four way pallets are used, more than one pallet arrestor may be required to prevent movement of a pallet.

The pallet arrestor may be provided in various bright colours such as yellow, red orange, or fluorescent or luminescent colours, so that it can be more easily seen by forklift operators.

It will further be appreciated that where a large number of pallets are stacked together, for example in stacks one behind another against a wall, the judicious use of a small number of pallet arrestors, may prevent any of the pallets in the stack being moved by a fork lift.

It will be further appreciated that the shape size and profile of the pallet arrestor may be changed to suit different pallet types. Handles may be provided on the front of the pallet arrestor for ease of removal. The pallet arrestor may be provided in various bright colours so that they can be easily seen by forklift drivers. The front of the pallet arrestor may be embossed with information such as the date on which the pallet arrestor 12 may be removed from the pallet.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A method of quarantining pallets, said pallets defining one or more pallet tunnels for receiving the tines of a forklift, the method comprising:

providing a pallet arrestor which is shaped and configured, in use, to locate in one of the tunnels of the pallet wherein the pallet arrestor includes a first portion which is configured to slot into a pallet tunnel and a second, or front, portion whose size and/or configuration prevents its entry into the pallet tunnel, which pallet arrestor also defines a latch which in one (retracted) position allows the pallet arrester to be inserted and removed from the pallet tunnel and which in a second (locked) position prevents or inhibits the removal of the pallet arrestor from the pallet tunnel;

inserting the pallet arrestor into a tunnel of the pallet to prevent ingress of a forklift tine into that tunnel; and securing the pallet arrestor in the pallet tunnel by movement of the latch to the locked position.

2. A method as claimed in claim 1, wherein the latch is rotatably mounted on a distal end of the pallet arrestor and is rotatable between the retracted and locked positions, and further including rotating the latch to the locked position.

3. A method as claimed in claim 2, wherein the pallet includes an upper surface defined by a series of at least two planks and wherein in the locked position, the latch locates between two of the series of planks forming the upper surface of the pallet.

4. A method as claimed in claim 2, wherein the pallet arrestor includes a key operated lock located on the front portion of the pallet arrestor.

5. A method as claimed in claim 1, wherein the pallet arrestor is made from a moulded plastics material.

6. A method as claimed in claim 1, wherein the front portion of the pallet arrestor displays information relating to a permitted release date of the pallet.

7. A method of quarantining pallets, said pallets defining one or more pallet tunnels for receiving the tines of a forklift, the method comprising:

inserting a pallet arrestor which is shaped and configured, in use, to locate in one of the tunnels of the pallet; and securing the pallet arrestor in the pallet tunnel to prevent ingress of a forklift tine into that tunnel.

8. A method of quarantining pallets as claimed in claim 7 wherein the pallet arrestor is secured in the pallet tunnel by friction.

9. A method of quarantining pallets as claimed in claim 7 wherein the pallet arrestor is secured in the pallet tunnel by operation of a key-operated lock moving a lever.

10. A method as claimed in claim 7, wherein the pallet arrestor is made from a moulded plastics material.

* * * * *